US005992201A

United States Patent [19]

Ginzburg

[11] Patent Number: 5,992,201

[45] Date of Patent: Nov. 30, 1999

[54] ROLLING AND SHEARING PROCESS AND APPARATUS BACKGROUND

[75] Inventor: Vladimir B. Ginzburg, Pittsburgh, Pa.

[73] Assignees: Danieli United; International Rolling Mill Consultants, Inc., both of Pittsburgh, Pa.

[21] Appl. No.: 09/206,532

[22] Filed: Dec. 7, 1998

[51] Int. Cl.[6] ..... B21B 41/06; B21B 39/08

[52] U.S. Cl. ..... 72/229; 72/205

[58] Field of Search ..... 72/229, 205, 199, 72/234, 366.2, 365.2, 235, 224

[56] References Cited

U.S. PATENT DOCUMENTS

| | | | |
|---|---|---|---|
| 3,709,017 | 1/1973 | Vydrin et al. | 72/205 |
| 3,823,593 | 7/1974 | Vydrin et al. | 72/205 |
| 3,839,888 | 10/1974 | Greenberger | 72/205 |
| 3,871,221 | 3/1975 | Vydrin et al. | 72/205 |
| 4,244,203 | 1/1981 | Pryor et al. | 72/205 |
| 4,267,720 | 5/1981 | Vydrin et al. | 72/205 |
| 4,382,375 | 5/1983 | Yamamoto et al. | 72/205 |
| 4,414,832 | 11/1983 | Brenneman et al. | 72/8 |
| 4,478,064 | 10/1984 | Brenneman | 72/232 |

FOREIGN PATENT DOCUMENTS

| | | |
|---|---|---|
| 54-046159 | 11/1979 | Japan . |
| 55-094706 | 7/1980 | Japan . |

*Primary Examiner*—Rodney Butler
*Attorney, Agent, or Firm*—Armstrong, Westerman, Hattori, McLeland & Naughton

[57] ABSTRACT

A reversing rolling mill for rolling metal strip includes an entry side coiler and an exit side coiler and at least one mill rolling stand including a central roll, an entry side outer roll and an exit side outer roll having their respective longitudinal axes disposed in a first, horizontal, plane and parallel to a longitudinal axis of the central roll, a top outer roll in contact with the central roll, and a bottom outer roll, longitudinal axes of the top outer roll and bottom outer roll being disposed in a second, vertical, plane passing through the longitudinal axis of the central roll and parallel thereto, motors to drive the rolls and rotate the rolls about their respective longitudinal axes, devices to vertically move the central roll and the top outer roll, and devices to move the side outer rolls horizontally and to move the bottom outer roll vertically into and out of rolling contact with the central roll in a lowered position of the central roll.

10 Claims, 11 Drawing Sheets

ROLLING AND SHEARING PROCESS AND APPARATUS BACKGROUND

FIELD OF THE INVENTION

This invention relates to a process and rolling mill apparatus, including a central roll, together with upper, lower, upstream and downstream rolls movable toward and away from the central roll, for rolling of metal strip with the application to the strip of compressive, tensile and shear stresses, providing enhanced control of strip profile and flatness during rolling, and enhancing ease of threading of the strip through the several mill rolls.

DESCRIPTION OF PRIOR ART

Strip rolling methods and apparatus, e.g. for improved gauge control, are known in which a plurality of rolls are used to compress and reduce strip thickness while stretching the strip by rotating the rolls in opposite directions and at different peripheral speeds, e.g. U.S. Pat. Nos. 3,709,017, 3,823,593, 3,871,221, 4,267,720 and 4,414,832.

U.S. Pat. No. 4,478,064 shows a rolling mill system with rolls arranged in serpentine fashion to provide a plurality of roll bites progressively reducing the thickness of the rolled strip.

U.S. Pat. No. 4,244,203 discloses a 4-high mill for increasing the percentage reduction per pass and in which three reductions are taken per serpentine pass of the strip through the rolls. A similar arrangement is shown in U.S. Pat. No. 4,382,375 which also discloses that the peripheral speed of a higher speed work roll is greater than the speed with which the strip leaves the roll pass formed by a pair of work rolls.

In Japanese Patent document 55-094,706 three peripheral work rolls are clustered around a central work roll at. spacings of 120° and strip under tension is rolled between the central and peripheral rolls.

In Japanese Patent document 54-46,150 two work rolls are in vertical alignment and one roll may be pivoted about its axis in the horizontal plane.

Despite such prior art improvements, difficulty in controlling the profile and flatness of metal strip during rolling remains a continuing problem and, with such multiple work roll arrangements, threading of the strip through the mill is difficult.

SUMMARY OF THE INVENTION

This invention provides a reversing rolling mill having a central work roll, top and bottom outer rolls and entry and exit side outer rolls opposed to the central work roll, each having a longitudinal axis whereby the central roll and the top and bottom outer rolls may be vertically moved above the plane of a strip passing from an entry reel, across the side outer rolls, to an exit reel, thereby facilitating threading of the mill, and the central and top outer roll lowered and the bottom outer roll raised to a rolling position. The central roll and the side outer rolls, or the central roll and the top and bottom outer rolls, may be crossed, in the form of "triple roll crossing" providing enhanced strip profile and flatness control.

DESCRIPTION OF PREFERRED EMBODIMENTS

Figure 1:
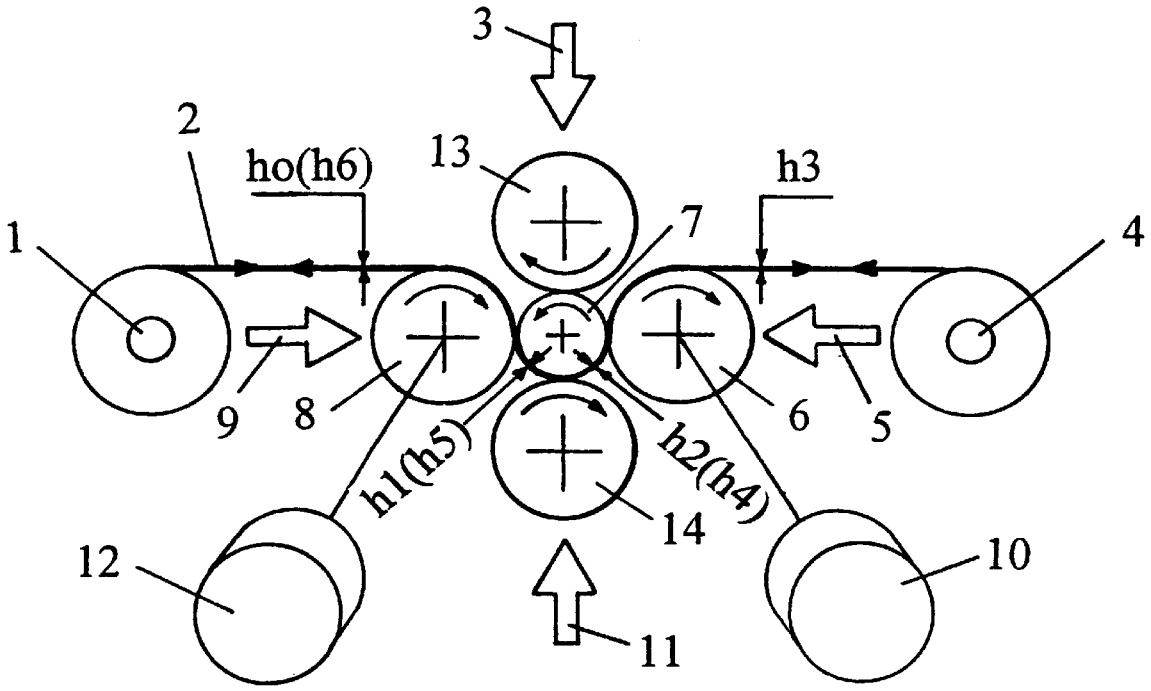
FIG. 1 is a side elevational sketch showing the reversing mill of this invention in operative rolling mode in which a rolled product 2 is reduced from thickness $h_0$ to $h_1$, $h_2$ and $h_3$ after rolling in one direction, and to $h_4$, $h_5$ and $h_6$ after rolling in the reverse direction.

In FIG. 1, the novel rolling mill of this invention comprises an entry side coiler 1 for coiling a metal strip 2. Means 3 is provided for vertical positioning of a central roll 7. An exit side coiler 4 is provided. Means 5 and 9 are provided for horizontal positioning, respectively, of an exit side outer roll 6 and an entry side outer roll 8 which are separately driven, respectively, by motors 10 and 12. A top outer roll 13 is provided, vertically movable by means 3, and a bottom outer roll 14 also is vertically movable by a means 11. Central roll 7, top outer roll 13 and bottom outer roll 14 also are individually driven by motors (not shown) similar to motors 10 and 12.

Figure 2:
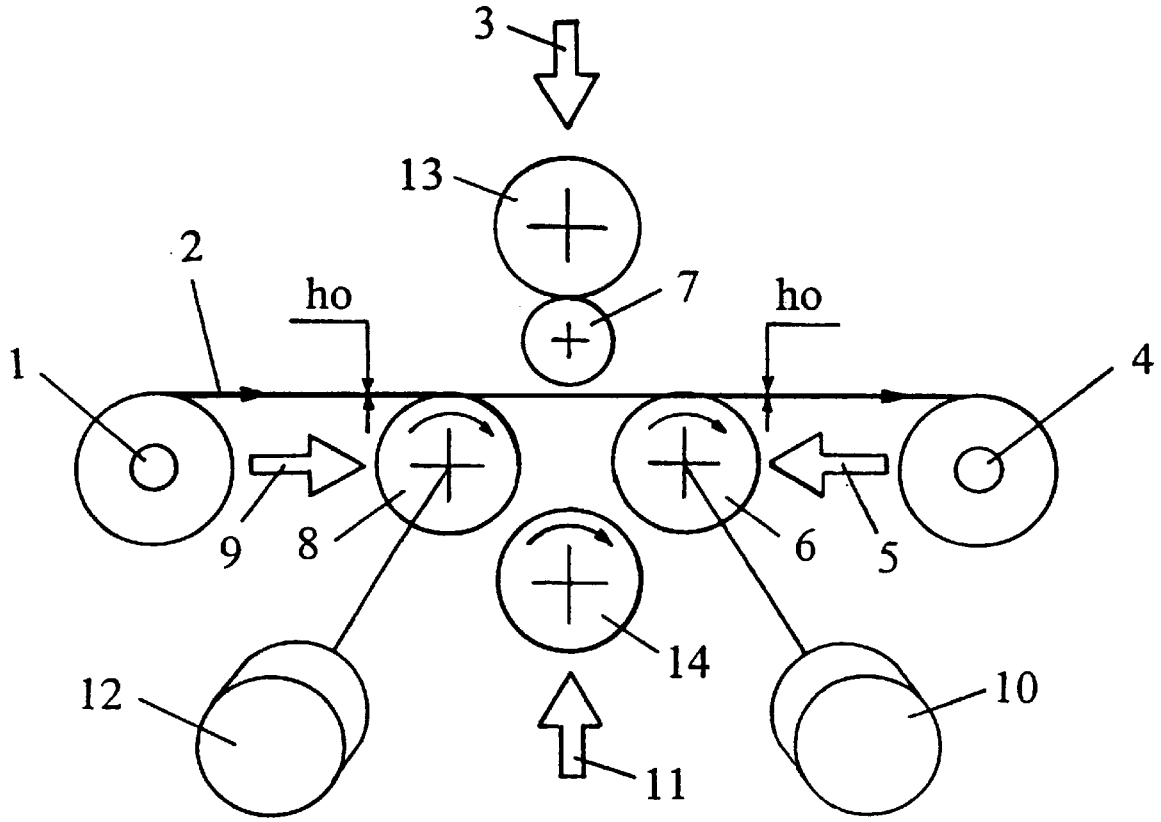
FIG. 2 is a side elevational sketch showing the reversing mill of FIG. 1 during a first stage of strip threading through the mill at which the central roll and the top and bottom outer rolls are retracted from the plane of the strip.
Figure 3:
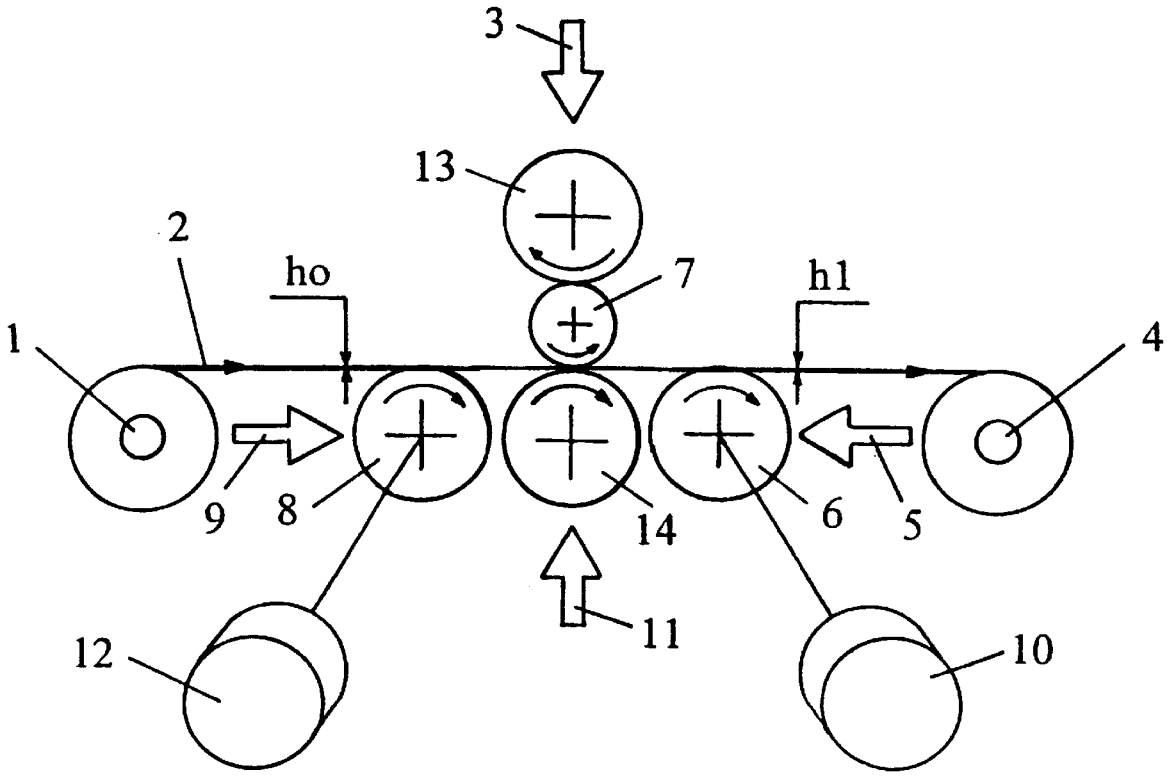
FIG. 3 is a side elevational sketch showing the reversing mill of FIG. 1 during a second stage of strip threading through the mill at which the bottom outer roll is raised to close the roll gap with the central roll.
Figures 4A, 4B:
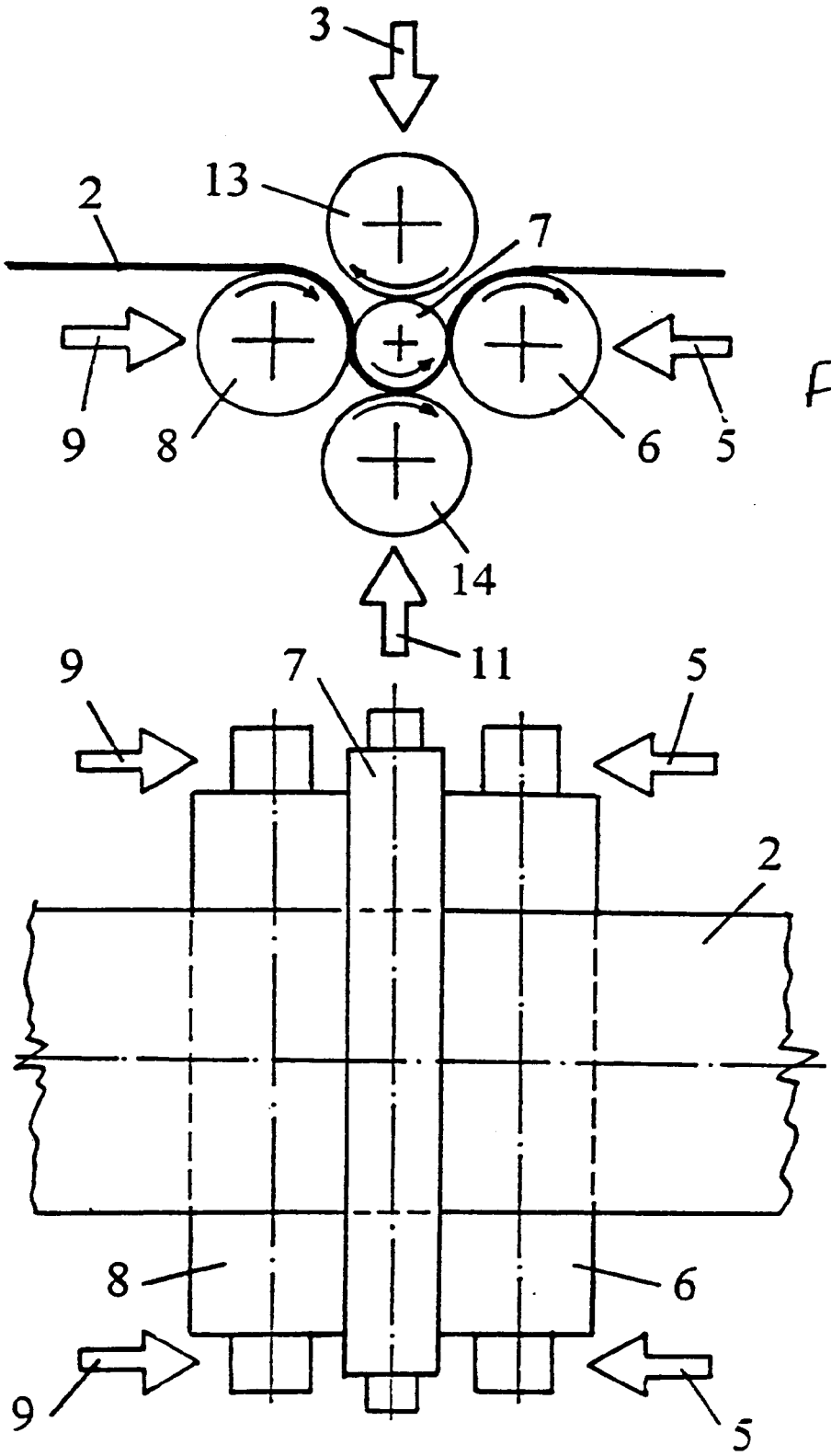
FIG. 4A is a side elevational sketch showing the reversing mill in operative rolling mode as shown in FIG. 1, with uncrossed rolls.
FIG. 4B is a top plan view of the mill of FIG. 4A.

The FIG. 1 mill, as shown in FIG. 2, is in a first stage of threading of the strip into the mill. The central roll 7 and associated upper outer roll 13 (which rolls may be mounted in an assembly so as to be vertically movable together), and the lower outer roll 14 are retracted, by means 3 and 11, allowing the strip 2 to be threaded directed across the tops of the side outer rolls 6 and 8, until after strip tension is established between coilers 1 and 4. A second stage of strip threading is shown in FIG. 3, in which the lower outer roll 14 is raised into rolling contact with the central roll 7 to reduce strip thickness from an initial thickness $h_0$ to thickness $h_1$. After the roll gap is thus closed, the roll assembly, comprising the upper outer roll 13 and the central roll 7, is lowered, the lower outer roll 14 is raised, and simultaneously the entry side outer roll 8 and the exit side outer roll 6 are brought into contact with the central roll 7, forming the mill configuration shown in FIG. 1 and in FIGS. 4A and 4B.

In the process of the invention, rolled product 2 is reduced in thickness by introducing three types of stresses, i.e.:

a. compressive stresses, by applying a force between the outer rolls 6, 8, 13 and 14 and the central roll 7 with use of the roll positioning means 3, 9, 5 and 11;

b. tensile stresses, by regulating the peripheral speeds of the outer rolls in respect to each other, and c. shear stresses by regulating the peripheral speeds of the outer rolls in respect to the speed of the central roll.

Each of the central and outer rolls 7, 6, 8, 13 and 14 (FIG. 1) is driven individually by a separate motor, so that, with use of those motors, the peripheral speed of each roll can be regulated independently from the others. Motors 10 and 12 are shown for driving the exit and entry side outer rolls 6 and 8; motors for central roll 7 and top and bottom outer rolls 13 and 14 are not shown.

To illustrate the creation of the tensile and shear stresses, consider rolling in the left-to-right direction. To define the required roll speeds, the mass flow peripheral speeds, $V_8$, $V_{14}$ and $V_6$ of the outer rolls 8, 14 and 6 are first determined according to the following relationship:

$$h_1(V_8)=h_2(V_{14})=h_3(V_6) \qquad \text{Equation 1}$$

where:

$h_1$, $h_2$, $h_3$=exit thicknesses after passes 1, 2, and 3 respectively.

The mass flow peripheral speed $V_7$ of the central roll 7 is equal to the mass flow peripheral speed $V_{14}$ of the lower outer roll 14, i.e. $V_7=V_{14}$.

To create tensile stresses in the rolled strip product, the peripheral velocity of the entry side outer roll 8 is maintained equal to the mass flows velocity $V_8$ while the peripheral velocities of the exit side outer roll 6 and the lower outer roll 14 are increased against the mass flow values $V_{14}$ and $V_6$ which are progressively increased to become equal to:

$$V_{14}'=V_{14}(1-A_{14}) \qquad \text{Equation 2}$$

$$V_6'=V_6(1-A_6) \qquad \text{Equation 3}$$

where:

$A_{14}$ and $A_6$ are the relative changes of the peripheral velocities of the rolls 14 and 6 respectively.

The values of $A_{14}$ and $A_6$ are selected as a function of strip thickness and width, and also of the rolled material grade, so that the tensile stress in the strip does not exceed about 80% of the material yield stress.

To create shear stresses in the rolled strip product, the peripheral velocity of the central roll 7 is changed against the mass flow velocity value $V_7$ to become approximately equal to the average peripheral velocity of the outer rolls 8, 14 and 6:

$$V_7' = \frac{V_8' + V_{14}' + V_6'}{3} \qquad \text{Equation 4}$$

Figure 5A:
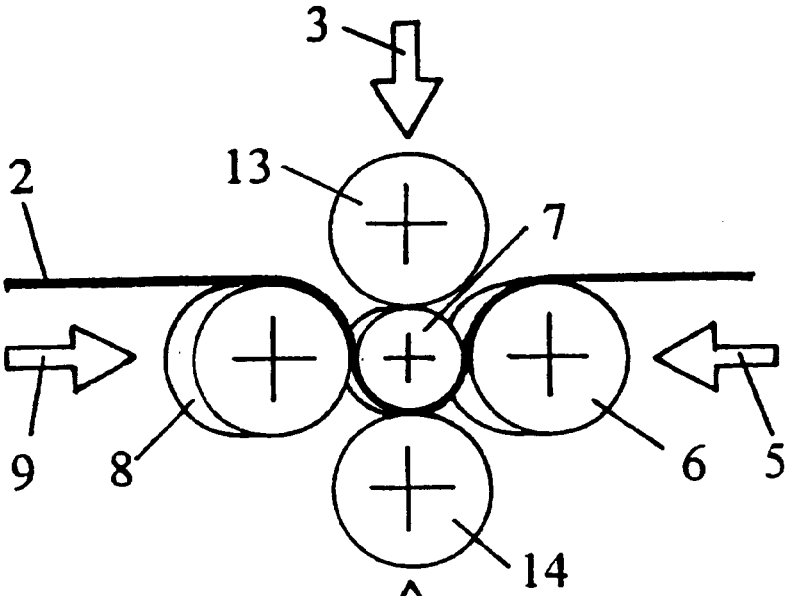
FIG. 5A is a side elevational sketch showing the reversing mill in operative rolling mode, as shown in FIG. 1 but with crossed central and side outer rolls.
Figure 5B:
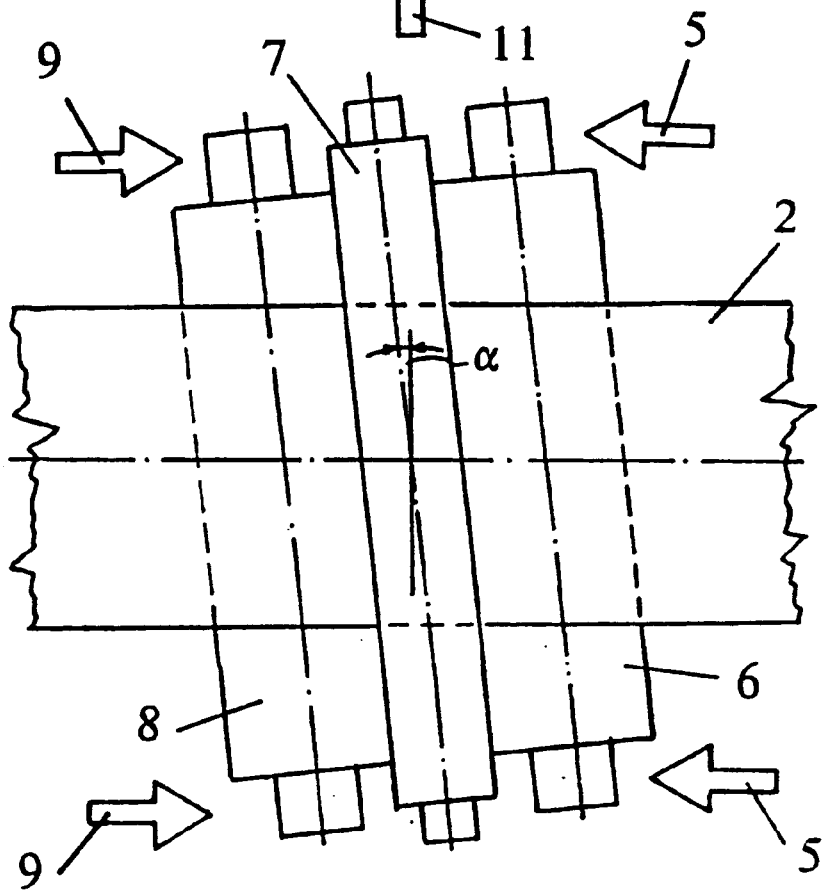
FIG. 5B is a top plan view of the mill of FIG. 5A.

The final adjustment of the peripheral velocity of the central roll 7 is made as a function of reductions at pass 1, 2 and respectively, roll separating force P and coefficient of friction in the roll bite $\mu$ that depends on the type of rolling lubricant used in the process and the shear stress $\tau$, in the roll bite of the i-th pass, in accordance with the following relationship:

$$\tau_i=f(r_i\ P_i\ \mu_i) \qquad \text{Equation 5}$$

where:

$r_i$=reduction for the i-th pass $P_i$=roll separating force for the i-th pass $\mu_i$=coefficient of friction in the roll bite of the i-th pass The apparatus of the invention also is capable of roll crossing. FIG. 5 shows both side and top plan views of the rolling mill of FIG. 1, with the axes of the entry outer roll 8, central roll 7, and exit outer roll 6 crossed in respect to the axes of the top outer roll 13 and bottom outer roll 14 by a cross angle $\alpha$. Such roll crossing is accomplished by the entry and exit outer roll positioning means 9 and 6 respectively. This is done by a simultaneous tilting of the roll stack that includes three ("triple crossing" rolls 8, 7 and 6.

Figure 6A:
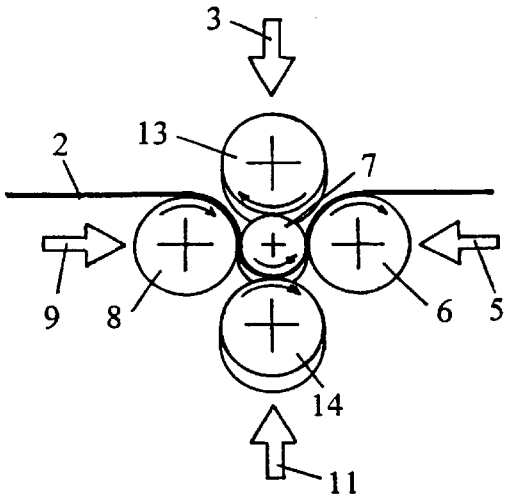
FIG. 6A is a side elevational sketch showing the reversing mill in operative rolling mode, as shown in FIG. 1 but with crossed central and top and bottom outer rolls.
Figure 6B:
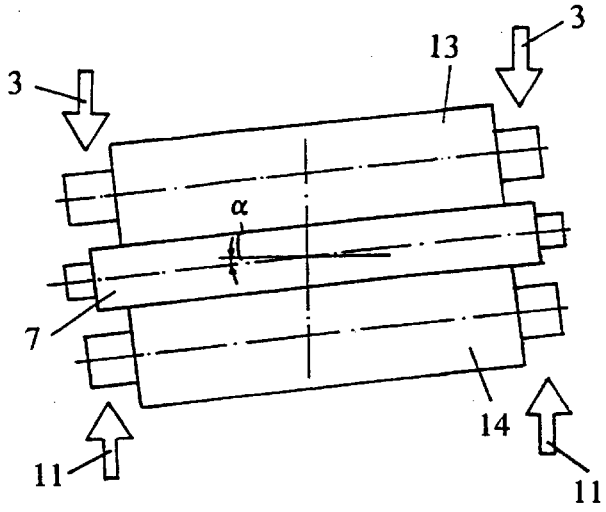
FIG. 6B is a top plan view of the mill of FIG. 6A.

FIGS. 6A and 6B shows crossing the central roll 7 in respect to the side outer rolls 8 and 6. This is done by a simultaneous tilting of the roll stack that includes three rolls, 13, 7 and 14.

Roll crossing results in progressive opening of the roll gap from the center of the roll toward its periphery, and works similarly as positive roll bending to increase control of strip profile and flatness. The latter properties are especially accurately controlled by the "triple roll crossing" as herein shown and above described.

Figure 7:
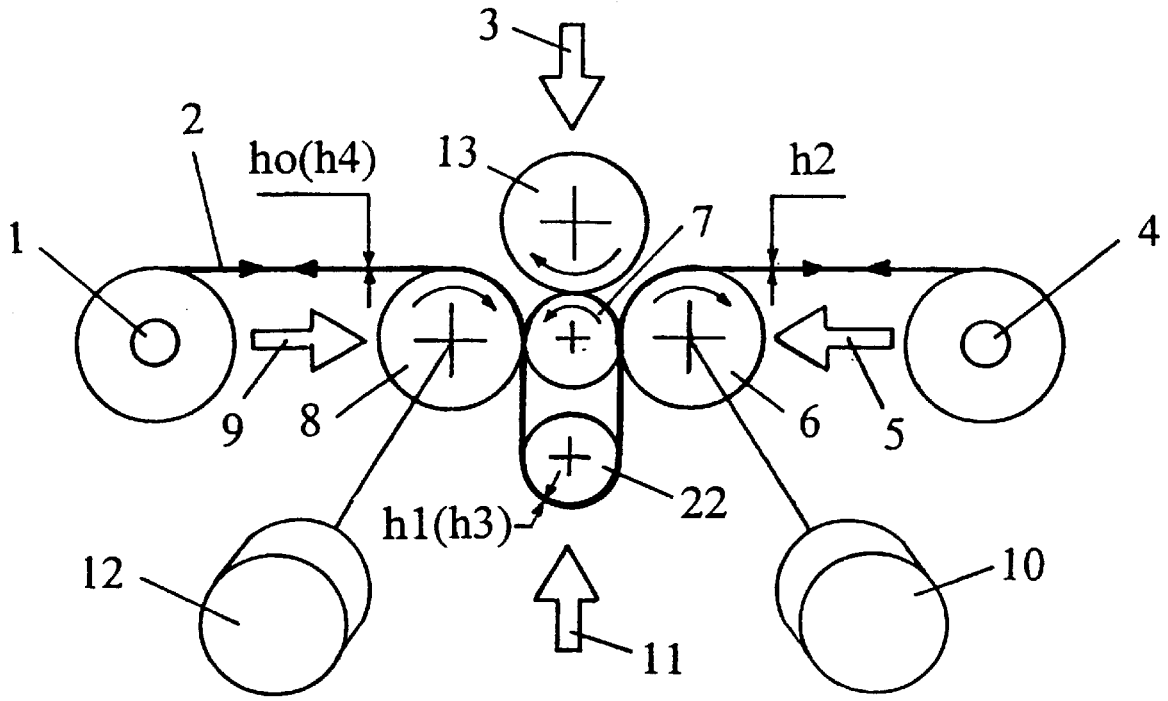
FIG. 7 is a view similar to FIG. 1, but with the bottom outer roll replaced with a tension roll.

FIG. 7 shows a modified rolling mill of this invention, similar to that of FIG. 1, but wherein the bottom outer roll 14 is replaced with a tension roll 22. This modified mill reduces the rolled strip product from thickness $h_0$ to $h_1$ and $h_2$ after rolling in one direction, and to $h_3$ and $h_4$ after rolling in a reverse direction.

Figure 8:
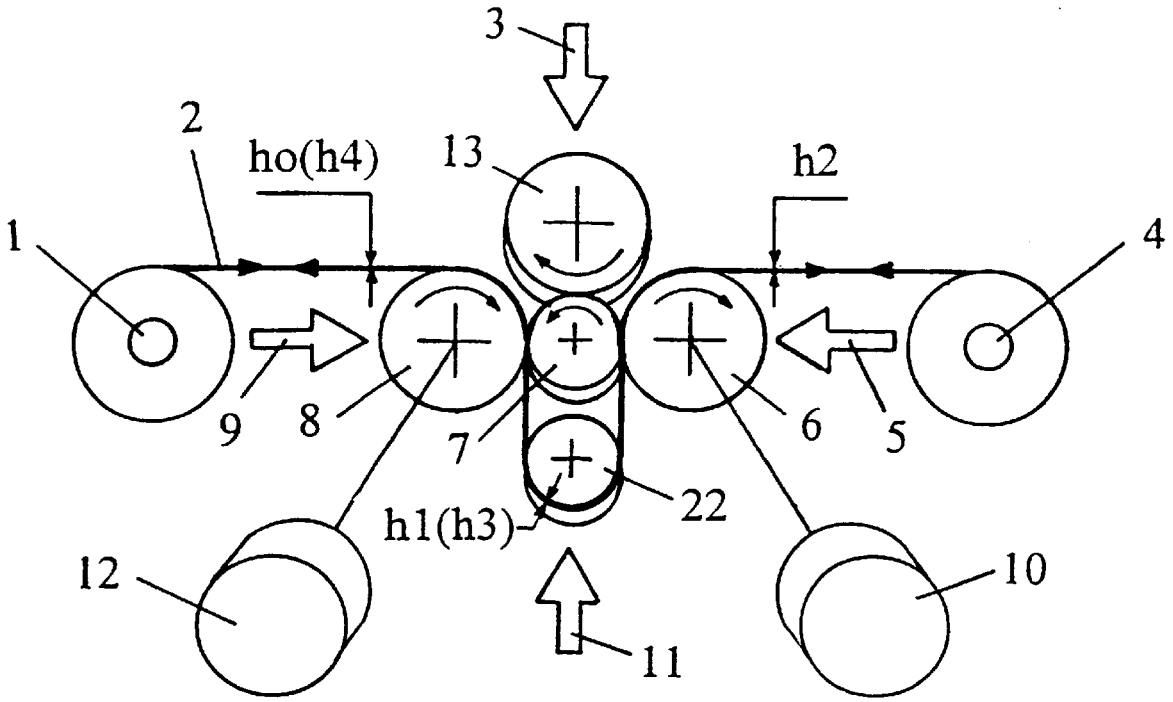
FIG. 8 is a view similar to FIG. 7, wherein the top outer roll, the central roll and the tension roll are crossed with respect to the side outer rolls.

As shown in FIG. 8, the modified mill of FIG. 1 also is amenable to triple roll crossing in accordance with the principles of this invention. Thus, in FIG. 8, the axes of top outer roll 13, central roll 7, and tension roll 22 are crossed in respect to the axes of the entry outer roll 8 and the exit outer roll 6, with the beneficial results thereof as aforementioned.

Figure 9:
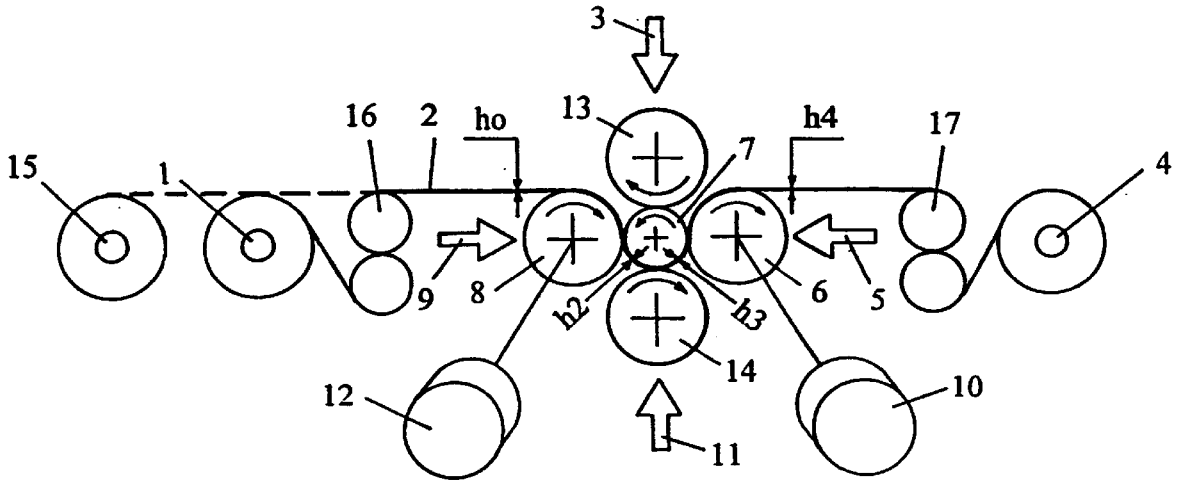
FIG. 9 is a view similar to FIG. 1 but showing a modified mill having a pay-off reel and entry and exit bridles.

FIG. 9 shows a further modification of the mill shown in FIG. 1, including, as additional equipment, a pay-off reel 15 and entry and exit bridles 16 and 17, respectively, to further control the tension applied to the strip product during rolling.

Figure 10:
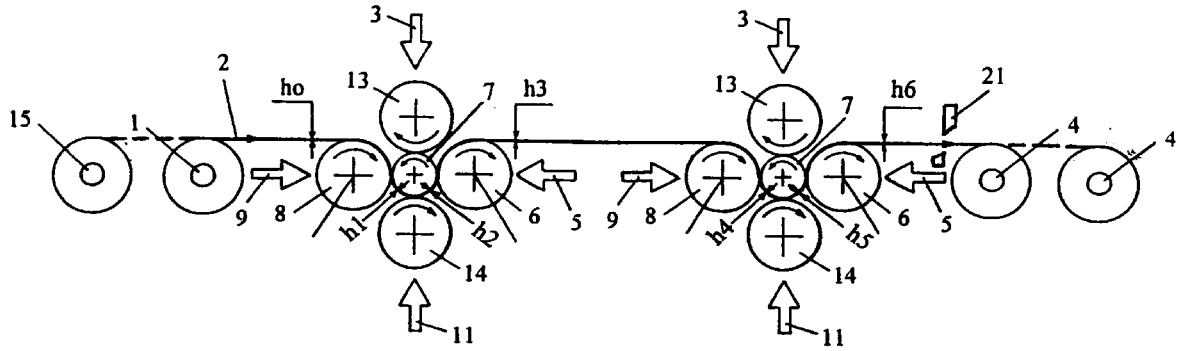
FIG. 10 is a side elevational sketch showing two mill stands of FIG. 1 rolling in tandem and with the addition of a pay-off reel, a shear, and a second exit side coiler.

FIG. 10 shows two mill stands like that of FIG. 1, rolling in tandem, with the following added equipment: pay-off reel 15, shear 21 and a second exit side coiler 4. As shown, in a single pass through such a tandem mill, strip thickness is reduced from its initial thickness $h_0$ to $h_1$, to $h_2$ to $h_3$ in a first mill stand and then from $h_3$ to $h_4$, to $h_5$ to $h_6$ in a second mill stand.

Figure 11:
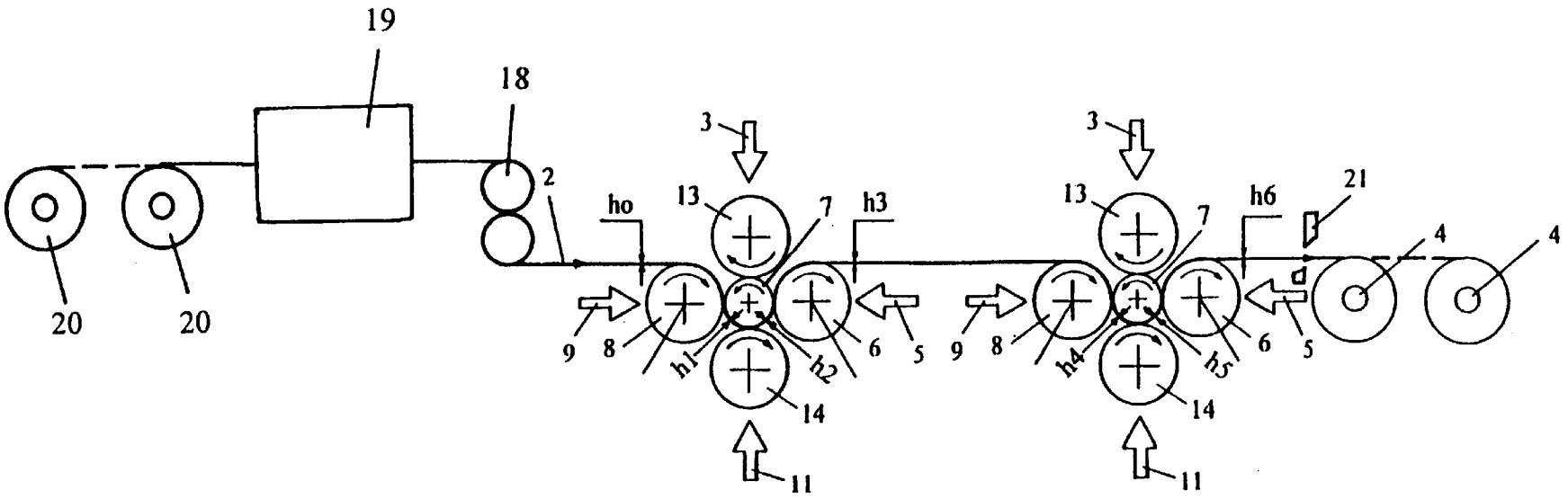
FIG. 11 is a side elevational sketch showing two tandem mill stands as in FIG. 1 and connected to either a strip accumulator or to a continuous process line.

FIG. 11 shows the tandem mill stands of FIG. 10 connected to a strip accumulator or a continuous process line 19 through a pair of steering rolls 18.

The rolling mill of this invention, either in a single stand configuration, or in a tandem stand configuration, enables multiple strip reductions per pass and, with the roll assemblies movable, as described, to raise or lower the central roll and top and bottom outer rolls, permits easy threading of the strip through the mill, with consequent materials and operational savings. Importantly, the triple roll crossing capability of the new mill provides exceptionally accurate control of rolled strip profile and flatness.

What is claimed is:

1. A reversing rolling mill for rolling metal strip comprising an entry side coiler and a first exit side coiler and at least one mill rolling stand comprising a central roll, an entry side outer roll and an exit side outer roll having their respective longitudinal axes disposed in a first, horizontal, plane and parallel to a longitudinal axis of the central roll, a top outer roll in contact with the central roll, a bottom outer roll, longitudinal axes of the top outer roll and the bottom outer roll being disposed in a second, vertical, plane passing through the longitudinal axis of the central roll and parallel thereto, means to drive the rolls and rotate the rolls about their respective longitudinal axes, means vertically to move the central roll and the top outer roll, and means to move the side outer rolls horizontally and to move the bottom outer roll vertically into and out of rolling contact with the central roll in a lowered position of the central roll.

2. A rolling mill according to claim 1, further comprising means to cross the longitudinal axes of the entry side outer roll, the central roll and the exit side outer roll with respect to the longitudinal axes of the top outer roll and the bottom outer roll.

3. A rolling mill according to claim 1, wherein the bottom outer roll is replaced with a tension roll.

4. A rolling mill according to claim 1, further comprising a pay-off reel disposed upstream of the entry side coiler, an entry side bridle disposed between the entry side coiler and the entry side outer roll, and an exit side bridle disposed between the exit side coiler and the exit side outer roll.

5. A tandem reversing rolling mill comprising at least two mill stands according to claim 1, a pay-off reel disposed upstream of the entry side coiler of a first mill stand, a shear disposed between the exit side coiler and the exit side outer roll of a second mill stand, and a second exit side coiler disposed downstream from the first exit side coiler.

6. A rolling mill according to claim 2, further comprising means to cross the longitudinal axes of the top outer roll, the central roll and the bottom outer roll with respect to the longitudinal axes of the entry side outer roll and the exit side outer roll.

7. A rolling mill according to claim 3, further comprising means to cross the longitudinal axes of the top outer roll, the central roll and the tension roll with respect to the longitudinal axes of the entry side outer roll and the exit side outer roll.

8. A rolling mill according to claim 3, further comprising means to cross the longitudinal axes of the entry side outer roll, the central roll and the exit side outer roll with respect to the longitudinal axes of the top outer roll and the tension roll.

9. A rolling mill according to claim 5, further comprising a strip accumulator disposed between the entry side coiler and the entry side outer roll of the first mill stand.

10. A rolling mill according to claim 5, further comprising a strip process treatment section disposed between the entry side coiler and the entry side outer roll of the first mill stand.

* * * * *

UNITED STATES PATENT AND TRADEMARK OFFICE

CERTIFICATE OF CORRECTION

PATENT NO. : 5,992,201

DATED : November 30, 1999

INVENTOR(S) : Vladimir B. Ginzburg

It is certified that error appears in the above-identified patent and that said Letters Patent is hereby corrected as shown below:

Title page, item [54] and col. 1, line 2, in the Title, should read --ROLLING AND SHEARING PROCESS AND APPARATUS--

Signed and Sealed this

Thirtieth Day of May, 2000

*Attest:*

Q. TODD DICKINSON

*Attesting Officer*

*Director of Patents and Trademarks*